US005596845A

United States Patent [19]

Strizki

[11] Patent Number: 5,596,845

[45] Date of Patent: Jan. 28, 1997

[54] ADJUSTABLE SAFETY BREAKAWAY MOUNTING APPARATUS

[76] Inventor: Richard Strizki, Box 66-K, R.R. #1, Uniondale, Pa. 18470

[21] Appl. No.: 434,629

[22] Filed: May 4, 1995

[51] Int. Cl.[6] ..... E04B 1/00

[52] U.S. Cl. ..... 52/98; 52/295; 52/707; 403/13; 403/299; 403/306

[58] Field of Search ..... 52/707, 710, 98, 52/295, 296; 403/2, 299, 306, 307, 13; 411/111, 112, 113, 108, 432

[56] References Cited

U.S. PATENT DOCUMENTS

| | | | |
|---|---|---|---|
| 1,281,416 | 10/1918 | Pratt . | |
| 2,954,647 | 10/1960 | Lee | 52/707 |
| 3,236,019 | 2/1966 | Ballou . | |
| 3,507,315 | 4/1970 | Tummarello | 52/710 |
| 3,521,413 | 7/1970 | Scott et al. . | |
| 3,630,474 | 12/1971 | Minor . | |
| 3,637,244 | 1/1972 | Strizki . | |
| 3,713,262 | 1/1973 | Jatcko . | |
| 3,837,752 | 9/1974 | Shewchuk . | |
| 3,856,242 | 12/1974 | Cook . | |
| 3,951,556 | 4/1976 | Strizki . | |
| 3,967,906 | 7/1976 | Strizki . | |
| 3,974,372 | 8/1976 | Cochran . | |
| 4,007,564 | 2/1977 | Chisholm . | |
| 4,032,098 | 6/1977 | Marschak . | |
| 4,052,826 | 10/1977 | Chisholm . | |
| 4,084,362 | 4/1978 | Piazza . | |
| 4,095,381 | 6/1978 | Garchinsky . | |
| 4,269,384 | 5/1981 | Saeed et al. . | |
| 4,330,926 | 5/1982 | McCall | 403/2 X |
| 4,435,930 | 3/1984 | Plym . | |
| 4,437,427 | 3/1984 | Mampaeij . | |
| 4,528,786 | 7/1985 | Dinitz et al. . | |
| 4,630,413 | 12/1986 | Svensson . | |
| 4,638,608 | 1/1987 | Coy . | |
| 4,674,907 | 6/1987 | Shewchuk . | |
| 4,738,058 | 4/1988 | Svensson . | |
| 4,751,801 | 6/1988 | Andersson . | |
| 4,923,319 | 5/1990 | Dent . | |
| 4,926,592 | 5/1990 | Nehls . | |
| 4,928,446 | 5/1990 | Alexander, Sr. . | |
| 5,004,366 | 4/1991 | Simmons . | |
| 5,088,683 | 2/1992 | Briden . | |
| 5,228,250 | 7/1993 | Kesselman . | |

*Primary Examiner*—Carl D. Friedman
*Assistant Examiner*—Timothy B. Kang
*Attorney, Agent, or Firm*—Sperry, Zoda & Kane

[57] ABSTRACT

An improved mounting apparatus which is adjustable for providing a safety breakaway capability for the attachment of post assemblies normally adjacent to a road or highway location wherein the vertical post assembly includes mounting holes located in a foundation therebelow. The improved breakaway apparatus includes a plurality of anchors fixedly secured to the foundation and a breakaway coupling interconnecting the anchor to the vertical post assembly. The breakaway coupling includes a weakened section to facilitate breaking thereof responsive to a lateral force exerted adjacent to the lower end of the vertical post assembly. Securement of the breakaway coupling to the anchor is provided by a unique lateral and vertical adjustment design by providing of a lateral clearance space between the lower support member and the collar aperture while at the same time providing an annular clearance space between the coupling support shoulder and the collar lip within the containment bore. Also equal lateral clearance is provided between edges of the lower nut member and the anchor chamber. The vertical adjustment is accomplished by adjusting the vertical relative position between the anchor collar and the anchor body and by adding vertical adjustment spacers of different thicknesses as required in the bottom of the anchor chamber, prior to securement of the breakaway coupling member to the anchor.

20 Claims, 4 Drawing Sheets

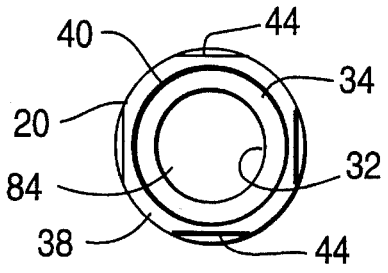
FIG. 8
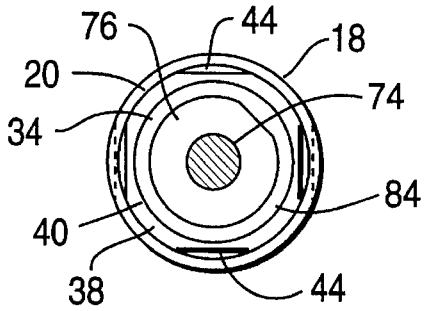
FIG. 9
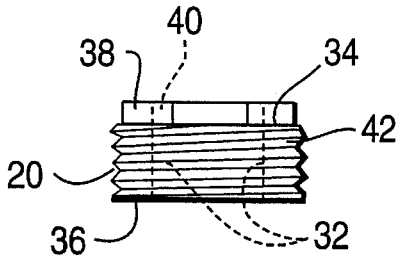
FIG. 7
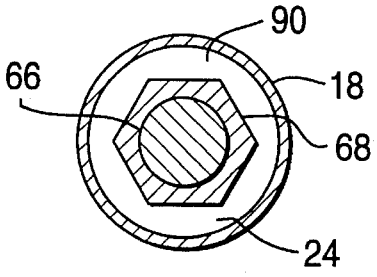
FIG. 10
FIG. 11
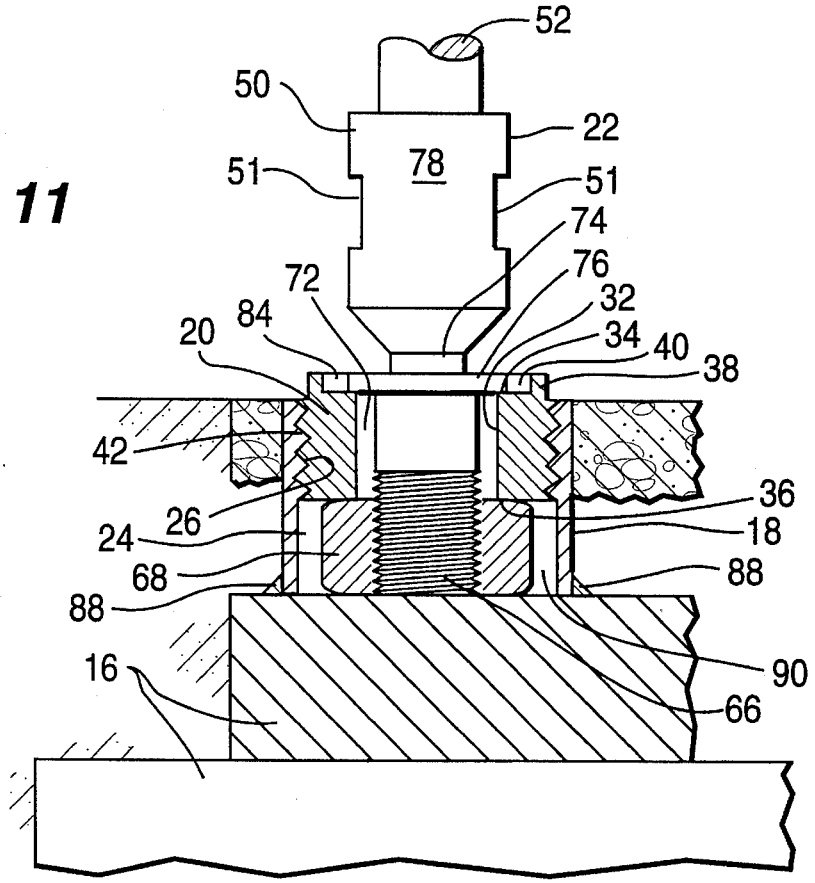

ADJUSTABLE SAFETY BREAKAWAY MOUNTING APPARATUS

BACKGROUND OF THE INVENTION

1. Field of the Invention

The present invention deals with the field of devices for mounting of signs, poles and other vertically extending structures along highways or roads. Many such highway and road signs are utilized for giving directions or exit identification or for general advertisements.

Such structures have historically been a great danger for motorists in view of the fact that impact with the substantially sized poles or posts by a vehicle during an accident would result in significant damage to the vehicle itself and injury to the driver and passengers within the vehicle. In recent years designs have been utilized to allow the posts to breakaway at the base by providing a safety mounting apparatus which performs the function of supporting the sign or other device adjacent to the road or highway while at the same time minimizing dangers to a motorist or his vehicle during a collision therewith. The present design provides an improvement over such prior art devices since the present design provides the capability for horizontal and vertical adjustment.

Normally when the post is attached to the ground a foundation or footing is used. Attachment means or anchors which are placed in these foundations to connect the post with the footing must be precisely aligned in order to match the extremely close attachment hole tolerances in the vertical post brackets. As such, the present invention provides a means for providing slight dimensions of adjustment in both the vertical and horizontal directions to allow for any slight imperfections or variations. Furthermore the present invention provides an upper support member on the breakaway coupling which includes an enlarged section with narrowed sections on both sides thereof to significantly aid in allowing tilting of the coupling members to facilitate ease of breaking of those coupling members responsive to a lateral force being exerted in the area immediately adjacent to the lower end of the vertical post assembly. In addition, the present invention provides post attachment brackets which are structurally and economically more efficient than previous designs.

2. Description of fhe Prior Art

In recent years numerous designs have been utilized in an attempt to provide breakaway mounting apparatus which is safe to the motorist while at the same time providing sufficient support for the mounting of signs or other structures adjacent to highways or roads. Examples of patents granted on such devices are shown in U.S. Pat. No. 1,281,416 issued Oct. 15, 1918 to W. M. Pratt on an "Insert For Concrete Construction"; and U.S. Pat. No. 3,236,019 issued Feb. 22, 1966 to H. G. Ballou and assigned to Superior Concrete Accessories, Inc. on a "Dual Anchoring Insert For A Tilt-Up Concrete Slab Or The Like"; and U.S. Pat. No. 3,521,413 issued Jul. 21, 1970 to M. O. Scott et al on "Breakaway Base Support For Roadside Standards"; and U.S. Pat. No. 3,630,474 issued Dec. 28, 1971 to R. Minor and assigned to Kearney-National Inc. on a "Breakaway Pole Support Structure"; and U.S. Pat. No. 3,637,244 issued Jan. 25, 1972 to R. Strizki on a "Load Concentrated Breakaway Coupling"; and U.S. Pat. No. 3,713,262 issued Jan. 30, 1973 to J. Jatcko on a "Taper Lock Break-Away Pole Structure"; and U.S. Pat. No. 3,837,752 issued Sep. 24, 1974 to J. Shewchuk on a "Coupling For Break Away Pole Bases"; and U.S. Pat. No. 3,856,242 issued Dec. 24, 1974 to B. Cook and assigned to General Electric Company on a "Mounting Apparatus For A Surge Voltage Arrester"; and U.S. Pat. No. 3,951,556 issued Apr. 20, 1976 to R. Strizki and assigned to Transpo-Safety, Inc. on a "Load Concentrated Breakaway Coupling Apparatus"; and U.S. Pat. No. 3,967,906 issued Jul. 6, 1976 to R. Strizki and assigned to Transpo-Safety, Inc. on "Safety Break-Away Ground Mounted Post Support Assemblies"; and U.S. Pat. No. 3,974,372 issued Aug. 10, 1976 to C. Cochran and assigned to The City of Portland on an "Ornamental Lighting Standard"; and U.S. Pat. No. 4,007,564 issued Feb. 15, 1977 to D. Chisholm on a "Breakaway Coupling And Assembly"; and U.S. Pat. No. 4,032,098 issued Jun. 28, 1977 to H. Marschak on a "Base For An Upright For Forming A Stand Or The Like"; and U.S. Pat. No. 4,052,826 issued Oct. 11, 1977 to D. Chisholm on a "Breakaway Coupling Assembly With Fracture-Initiating Washer"; and U.S. Pat. No. 4,084,362 issued Apr. 18, 1978 to M. Piazza and assigned to Maso-Therm Corporation on an "Anchored Composite Building Module"; and U.S. Pat. No. 4,095,381 issued Jun. 20, 1978 to J. Garchinsky and assigned to Gar Design Research, Inc. on a "Pole Base Mount Assembly"; and U.S. Pat. No. 4,269,384 issued May 26, 1981 to A. Saeed et al and assigned to DAF Indal Ltd. on "Collapsible Structures Employing Frangible Connections"; and U.S. Pat. No. 4,435,930 issued Mar. 13, 1984 to O. Plym on a "Traffic Safe Pole"; and U.S. Pat. No. 4,437,427 issued Mar. 20, 1984 to J. Mampaeij on a "Break Bollard"; and U.S. Pat. No. 4,528,786 issued Jul. 16, 1985 to A. Dinitz et al and assigned to Transpo Industries on a "Low Profile Break Safe Breakaway System"; and U.S. Pat. No. 4,630,413 issued Dec. 23, 1986 to L. Svensson on a "Post For Traffic Signs, Lighting And The Like"; and U.S. Pat. No. 4,638,608 issued Jan. 27, 1987 to W. Coy and assigned to Precisionform, Inc. on a "Breakaway Standard Support Assembly"; and U.S. Pat. No. 4,674,907 issued Jun. 23, 1987 to J. Shewchuk on a "Coupling Component For Breakaway Pole Bases"; and U.S. Pat. No. 4,738,058 issued Apr. 19, 1988 to L. Svensson on a "Post"; and U.S. Pat. No. 4,751,801 issued Jun. 21, 1988 to A. Andersson on a "Post For Traffic Signals And The Like"; and U.S. Pat. No. 4,923,319 issued May 8, 1990 To C. Dent on a "Breakaway Connector"; and U.S. Pat. No. 4,926,592 issued May 22, 1990 to C. Nehls and assigned to Unistrut International Corp. on a "Breakaway Sign Post Coupling"; and U.S. Pat. No. 4,928,446 issued May 29, 1990 to W. Alexander, Sr. on a "Break-Away Sign Post And Post Ground Anchor"; and U.S. Pat. No. 5,004,366 issued Apr. 2, 1991 to G. Simmons on a "Break-Away Coupling"; and U.S. Pat. No. 5,088,683 issued Feb. 18, 1992 to C. Briden and assigned to Cooper Industries, Inc. on a "Breakaway Pole Assembly"; and U.S. Pat. No. 5,228,250 issued Jul. 20, 1993 to D. Kesselman on a "Tamper Proof Anchor Bolt Assembly".

SUMMARY OF THE INVENTION

The present invention provides an improved safety breakaway mounting apparatus which is adjustable in a horizontal direction and also in a vertical direction in order to allow the attachment of a vertical post assembly with post bracket mounting holes defined therein with respect to a foundation such as a highway earthen area or footing. The improved configuration includes an anchor device fixedly secured to a foundation. This anchor includes an anchor body defining an anchor chamber therein. The anchor body preferably includes an anchor body threaded area thereon within the anchor chamber. This anchor body further defines a threaded orifice therein to facilitate mounting of securement bars thereto. The anchor body also includes a locking notch therein to facilitate fixed securement thereof with respect to a foundation especially when the foundation is a poured concrete footing. Such notches prevent rotation of the anchor body during installation of the securement bars and replacement of the coupling members.

The anchor of the present design may further include an anchor collar detachably and adjustably secured to the anchor body. This anchor collar preferably defines a collar aperture extending therethrough which is in communication with respect to the anchor chamber defined within the anchor body.

The anchor collar preferably also includes an upper collar abutment surface extending around the collar aperture and facing generally upwardly therefrom. Furthermore the anchor collar preferably includes a lower collar abutment surface extending around the collar aperture and facing generally downwardly therefrom. The anchor collar also includes a collar lip extending upwardly from the upper collar abutment surface and around the anchor aperture defined in the anchor collar. This collar lip and the upper collar abutment surface cooperate together in the shape of a general L-shape in cross section to define a containment bore thereadjacent facing upwardly.

An anchor collar threaded area is defined also in the anchor collar engageable with respect to the anchor body thread to facilitate vertically adjustable securement of the anchor collar with respect to the anchor body. A collar gripping flat may also be included located on the collar lip to facilitate control of rotational movement thereof for adjustment. An anchor rod may be also utilized including a threaded rod area which is securable with respect to the threaded orifice defined in the anchor body in such a manner as to attach the anchor rod with respect to the anchor body in such a manner that it extends downwardly from the anchor for facilitating securement of the anchor with respect to a foundation such as a poured concrete footing or the like.

The design of the present invention further includes a breakaway coupling device formed preferably as a single monolithic integral member including a main shaft member extending generally vertically with flats on the sides thereof to facilitate gripping with a wrench. The breakaway coupling further includes an upper support member securable with respect to the post bracket mounting hole defined in the vertical post assembly. This upper support member preferably includes a full diameter section as well as preferably two reduced diameter sections adjacent to the full diameter section immediately thereabove and therebelow and positioned within the post bracket mounting hole in order to facilitate symmetric positioning with respect to the post mounting hole and allow tilting of the breakaway coupling and aid in breaking thereof responsive to the exertion of lateral force near the bottom of the vertical post assembly. These reduced diameter sections are located above the full diameter section and below the full diameter section preferably to further facilitate this tilting action. Preferably the reduced diameter section can include a 45 degree angularly outwardly flared section extending from the full diameter section to the fully reduced diameter section.

The breakaway coupling means may also include an upper securement device operative to detachably secure the breakaway coupling to the vertical post assembly by securement of the upper support member in position extending through the post bracket mounting hole. This upper securement device shall preferably include an upper male threaded member located at the top of the upper support member as well as an upper nut member engageable with respect to the upper male threaded member above the post bracket mounting hole in such a manner as to detachably secure the breakaway coupling to the vertical post assembly.

The breakaway coupling may also include a lower support member detachably securable to the anchor body by securement thereof in position extending through the collar aperture into the anchor chamber. The lower support member is preferably smaller than-the collar aperture in such a manner as to define a lateral clearance space therebetween. This lateral clearance space will provide the capability for lateral movability of the breakaway coupling means with respect to the anchor collar and, as such, will allow lateral adjustment of the breakaway coupling with respect to the anchor.

The breakaway coupling may also include a lower securement device operative to detachably secure the breakaway coupling to the anchor body by securement of the lower support member in position extending through the collar aperture and into the anchor chamber therebelow. This lower securement device may include a lower male threaded member located at the bottom of the lower support member within the anchor chamber. Also a lower nut member may be engageable with respect to the lower male threaded member below the collar aperture within the anchor chamber to detachably affix the breakaway coupling with respect to the anchor body. This lower nut member is preferably engageable with respect to the lower collar abutment surface in such a manner as to affix the breakaway coupling with respect to the anchor collar.

The breakaway coupling will include a weakened section positioned between the upper support member and the lower support member and being breakable to facilitate release of the vertical post assembly from the anchor body responsive to the exertion of a lateral force near the bottom of the vertical post assembly in the area of the post adjacent to the breakaway coupling. A coupling support shoulder will also be included on the breakaway coupling positioned immediately below the weakened section. This coupling support shoulder will be adjustably retained within the containment bore in such a manner as to help to maintain vertical alignment of the breakaway coupling while at the same time allowing lateral adjustment thereof prior to tightening of the lower nut member.

The breakaway coupling also preferably includes a main shaft member having an enlarged coupling section whose upper surface is positioned below the upper support member for abutment with the load concentrating means and the vertical post assembly brackets and to facilitate securement of the upper support member with respect to the post bracket mounting hole. A load concentrating device such as a load concentrating washer or the like will be positioned between the centerline of the breakaway coupling means and the centerline of the vertical post assembly adjacent the post bracket mounting hole and having minimal effect on the weakened section responsive to lateral forces being exerted near the lower area of the vertical post assembly and to restrict breaking of the weakened section responsive to lateral force exerted on the vertical post assembly spatially distant from the breakaway coupling. A vertical spacing means may also be included within the anchor chamber means positioned below the breakaway coupling for vertical adjustment of the breakaway coupling and to facilitate tight abutment of the anchor body with respect to the lower nut member and the lower support member of the breakaway coupling.

A post bracket can be fixedly secured to the vertically extending post assembly and define the post bracket mounting holes therein. These holes are adapted to receive the breakaway coupling members extending therein for securement thereto. This construction has been found to be more economical and structurally efficient than prior designs. The shape of the vertical post bracket is preferably made of a horizontal base monolithic with a centrally located upper flange section or vertical leg to enhance strength characteristics of the configuration of the present invention.

It is an object of the present invention to provide an improved adjustable safety breakaway mounting apparatus for attachment of a vertical post assembly with post bracket mounting holes therein with respect to a foundation wherein the anchor into the foundation is horizontally adjustable with respect to the breakaway coupling.

It is an object of the present invention to provide an improved adjustable safety breakaway mounting apparatus for attachment of a vertical post assembly with post bracket mounting holes therein with respect to a foundation wherein the anchor collar is vertically adjustable with respect to the anchor body which is fixed secured to the foundation.

It is an object of the present invention to provide an improved adjustable safety breakaway mounting apparatus for attachment of a vertical post assembly with post bracket mounting holes therein with respect to a foundation wherein use with a fixed foundation, a poured foundation, a metallic foundation, an earthen foundation, or any normally configured foundation is possible.

It is an object of the present invention to provide an improved adjustable safety breakaway mounting apparatus for attachment of a vertical post assembly with post bracket mounting holes therein with respect to a foundation wherein the cost and time involved in installation of the breakaway mounting apparatus and post brackets is significantly reduced.

It is an object of the present invention to provide an improved adjustable safety breakaway mounting apparatus for attachment of a vertical post assembly with post bracket mounting holes therein with respect to a foundation wherein vertical alignment is properly maintained by allowing horizontal adjustment of the coupling with respect to the anchor body.

It is an object of the present invention to provide an improved adjustable safety breakaway mounting apparatus for attachment of a vertical post assembly with post bracket mounting holes therein with respect to a foundation wherein the anchor body can be fixedly secured against rotation in a footing by the definition of one or more notches therein.

It is an object of the present invention to provide an improved adjustable safety breakaway mounting apparatus for attachment of a vertical post assembly with post bracket mounting holes therein with respect to a foundation wherein a lateral clearance space is defined between the lower support member and the collar aperture to facilitate horizontal adjustment therebetween.

It is an object of the present invention to provide an improved adjustable safety breakaway mounting apparatus for attachment of a vertical post assembly with post bracket mounting holes therein with respect to a foundation wherein an annular clearance space is defined between the coupling support shoulder with respect to the collar lip within the containment bore to further facilitate horizontal adjustability in positioning of the breakaway coupling.

It is an object of the present invention to provide an improved adjustable safety breakaway mounting apparatus for attachment of a vertical post assembly with post bracket mounting holes therein with respect to a foundation wherein horizontal adjustability is provided by laterally movable securement between the breakaway coupling with its lower nut member and the anchor body and collar.

It is an object of the present invention to provide an improved adjustable safety breakaway mounting apparatus for attachment of a vertical post assembly with post bracket mounting holes therein with respect to a foundation wherein the upper support member below the upper male threaded member includes a reduced diameter section, a full diameter section and another reduced diameter section immediately therebelow to facilitate tilting of said breakaway coupling responsive to the exertion of a lateral force near the bottom of the vertical post assembly similar to the force exerted during an automotive accident therewith to facilitate rupturing of the weakened section.

It is an object of the present invention to provide an improved adjustable safety breakaway mounting apparatus for attachment of a vertical post assembly with post bracket mounting holes therein with respect to a foundation wherein the full diameter section of the breakaway coupling symmetrically positions the upper support member thereof within the extremely close tolerances of the diameter of the post bracket holes which is necessary for the proper functioning of the load concentrating means under normal loading conditions.

It is an object of the present invention to provide an improved adjustable safety breakaway mounting apparatus for attachment of a vertical post assembly with post bracket mounting holes therein with respect to a foundation wherein the main shaft member of the coupling includes an enlarged coupling section whose upper surface abuts with the load concentrating means fixedly connected to the post bracket to facilitate securement of the upper support member thereto.

It is an object of the present invention to provide an improved adjustable safety breakaway mounting apparatus for attachment of a vertical post assembly with post bracket mounting holes therein with respect to a foundation wherein the cost of installation is significantly reduced.

It is an object of the present invention to provide an improved adjustable safety breakaway mounting apparatus for attachment of a vertical post assembly with post bracket mounting holes therein with respect to a foundation wherein the cost of maintenance and repair of ruptured breakaway couplings is further significantly reduced.

It is an object of the present invention to provide an improved adjustable safety breakaway mounting apparatus for attachment of a vertical post assembly with post bracket mounting holes therein with respect to a foundation wherein efficiency of operation is significantly enhanced.

It is an object of the present invention to provide an improved adjustable safety breakaway mounting apparatus for attachment of a vertical post assembly with post bracket mounting holes therein with respect to a foundation wherein reliability is enhanced and resistance to wind pressures is greatly facilitated.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 7 is a side view of an embodiment of the anchor collar as used with the present invention;

FIG. 8 is a top plan view of the embodiment shown in FIG. 7;

FIG. 9 is a top cross-sectional view of FIG. 4 along lines 9—9;

FIG. 10 is a cross-sectional view of FIG. 4 taken along lines 10—10;

FIG. 11 is a cross-sectional view of an alternative embodiment of the improved adjustable safety breakaway mounting apparatus of the present invention;

DETAILED DESCRIPTION OF THE PREFERRED EMBODIMENT

Figure 1:
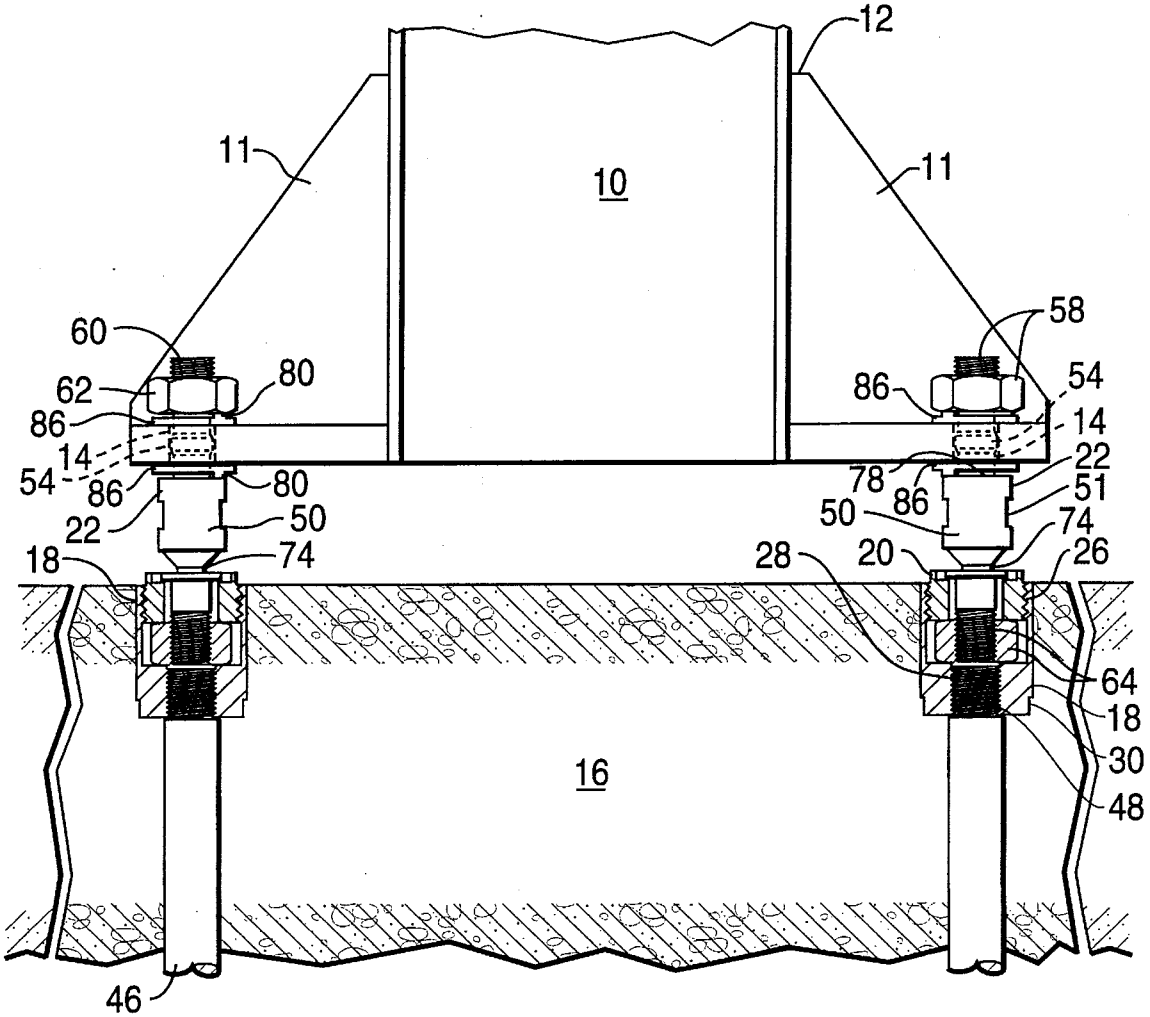
FIG. 1 is a side partial cross-sectional view of an embodiment of the improved adjustable safety breakaway mounting apparatus of the present invention.

The present invention provides an adjustable safety breakaway mounting apparatus which provides a means for mounting of posts 10 or other similarly vertically extending members with respect to a foundation 16 positioned therebelow. The post 10 preferably includes a vertical post assembly 12. Post assembly 12 preferably includes a vertical post bracket 11 which defines a plurality of post bracket mounting holes 14 extending therethrough. Post bracket 11 preferable is T-shaped or of an angular configuration to enhance strength characteristics thereof. The mounting apparatus of the present invention provides a means for mounting of the post 10 by way of these post bracket mounting holes 14 with respect to the foundation 16. The foundation 16 can be configured in any conventional manner. In normal configurations the foundation 16 will comprise a footing which is of poured concrete. This is the normal manner in which post assemblies 12 were mounted with respect to the ground adjacent to highways or roads. The foundation 16, however, could also be a rock or earthen area. It could be a pre-formed cement roadway, a metal shaft or any other structured surface adjacent the earth found near roads and highways.

In the configuration of the breakaway mounting apparatus of the present invention an anchor body 18 is designed to be fixedly mounted within the foundation 16. The anchor body 18 is preferably located below the upper surface of the foundation 16 and is preferably flush with the upper surface of this foundation when positioned therewithin.

The anchor body 18 preferably defines an anchor chamber 24 therein which is positioned below the upper surface of the foundation 16 when placed in position. The anchor chamber 24 includes an anchor body thread means 26 defined therein. This anchor body thread means 26 is included to facilitate vertical adjustability and securement of the anchor collar device 20 of the mounting apparatus of the present invention.

The anchor body 18 also includes a locking notch 30 to prevent rotation of the anchor body 18 during installation of the anchor rod 46 and replacement of the breakaway couplings 22.

An anchor collar 20 preferably includes a collar aperture 32 extending vertically therethrough. The portion of the anchor collar 20 immediately adjacent to the upper end of the collar aperture 32 preferably comprises an upper collar abutment surface 34. In a similar manner the portion of the anchor collar 20 immediately below the collar aperture 32 on the anchor collar 20 comprises the lower collar abutment surface 36. A collar lip 38 preferably extends upwardly from the upper collar abutment surface 34 to facilitate gripping and adjustment of the positioning of the anchor collar 20 with respect to the anchor body 18. Collar lip 38 defines a containment bore 40 therewithin. The relative position between these two parts provides the element of upward adjustment and securement of the mounting apparatus of the present invention. For this reason the anchor collar 20 will preferably include an anchor collar thread means 42 preferably around the external surface thereof which is adapted to engage the anchor body thread 26 defined within the anchor chamber 24. Thus, as the anchor collar 20 is rotated and threaded downwardly into engagement with the anchor body 18 it will move gradually into the anchor chamber 24. The collar lip 38 will extend upwardly therefrom to provide a means for rotation of the anchor collar 20 to place it in a position within the anchor body 18 and particularly within the anchor chamber 24.

This anchor collar 20 and in particular the collar lip 38 thereof preferably includes a collar gripping flat 44 to facilitate grasping thereof by wrenches or other familiar hand tools to facilitate tightening or loosening of the threaded engagement means.

Figure 2:
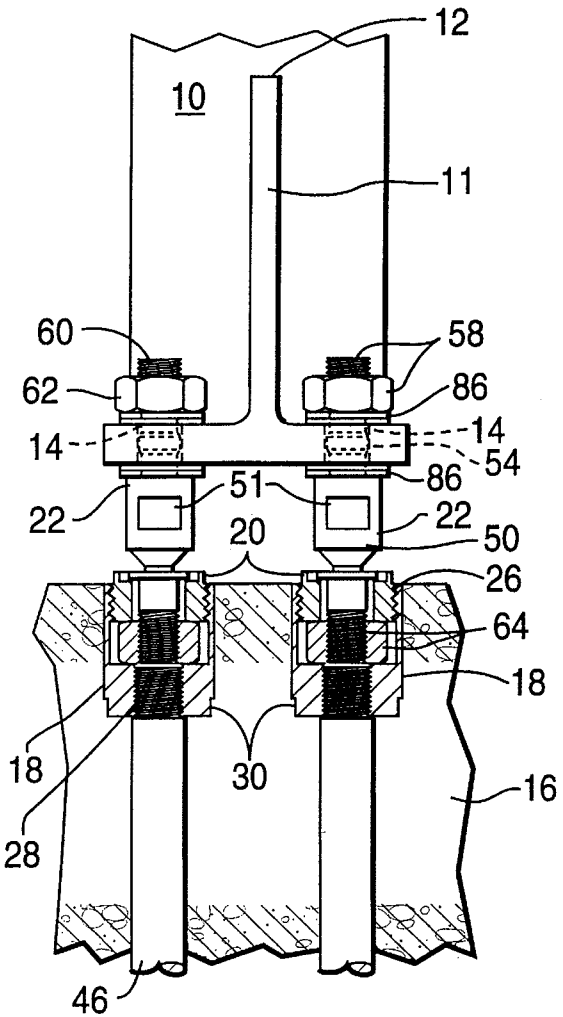
FIG. 2 is a front view of the embodiment shown in FIG. 1.
Figure 5:
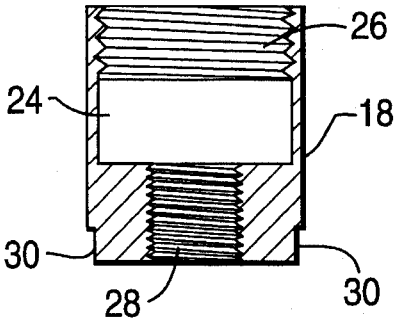
FIG. 5 is a side view of an embodiment of the anchor body of the present invention.
Figure 12:
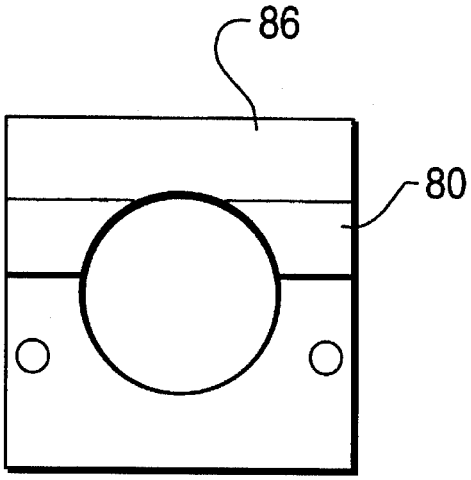
FIG. 12 is a top plan view of an embodiment of the load concentrating means for use with the present invention showing a top plan view of a load concentrating washer.
Figure 13:
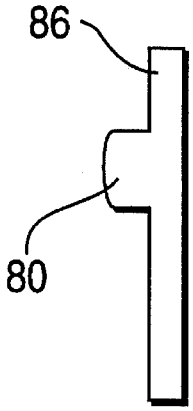
FIG. 13 is a side view of the washer configuration depicted in FIG. 12.

The configuration of the anchor body 18 will preferably include a threaded orifice 28 therein. This threaded orifice will be mated with the threaded rod area 48 defined on an anchor rod 46. This threaded orifice 28 may continue through the anchor chamber 24 and into the lower portion of the anchor body 18 as shown in FIG. 5 or it may terminate prior to reaching the lower surface of the anchor chamber 24 allowing the chamber bottom to remain solid. This second configuration will prevent foreign substance or moisture from entering the threaded orifice 28 and moving therethrough. The anchor rod 46 is adapted to be secured with respect to the anchor body 18 to extend preferably downwardly therefrom into the foundation 16 or footing to facilitate securement between the anchor body 18 and the foundation 16. This configuration is best shown in FIGS. 1 and 2. These anchor rods 46 can extend in multiple directions from the anchor bodies 18 to facilitate firm securement thereof with respect to the foundation or footing 16.

A breakaway coupling 22 of a specific configuration is designed to be movably secured with respect to the anchor collar 20. The configuration of the breakaway coupling 22 includes a main shaft member 50 having an upper support member 52 to facilitate securement of the breakaway coupling 22 with respect to the vertical post assembly 12. In a similar manner a lower support member 70 extends downwardly from the main shaft member 50 and is adapted to facilitate securement of the breakaway coupling 22 with the anchor collar means 20 and with respect to the anchor body 18 located therebelow.

Figure 3:
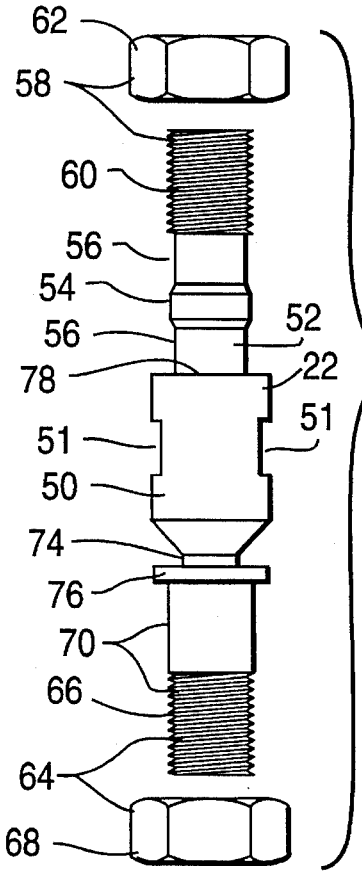
FIG. 3 is a side view of an embodiment of the breakaway coupling of the present invention.
Figure 6:
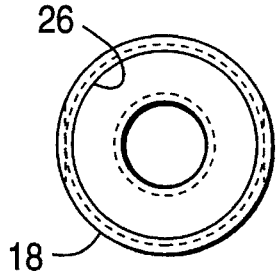
FIG. 6 is a top plan view of the embodiment shown in FIG. 5.
Figure 4:
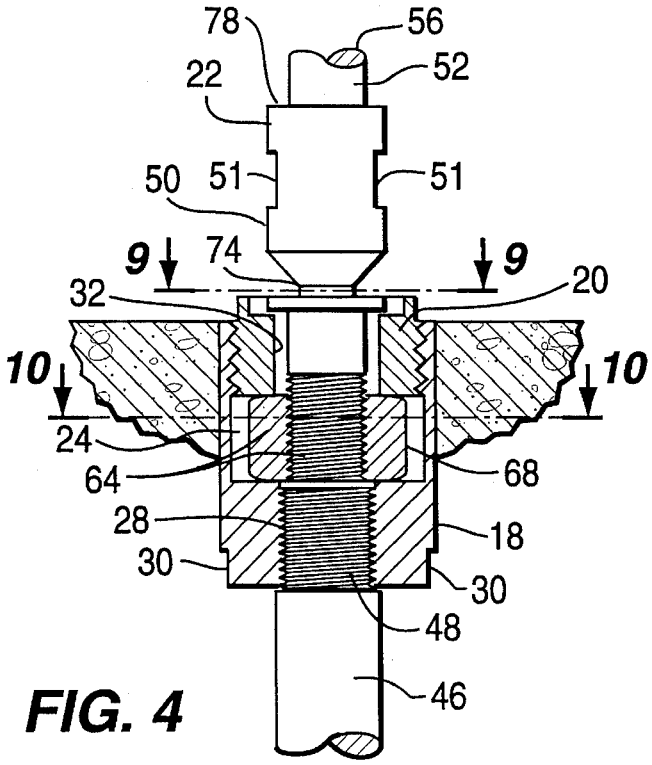
FIG. 4 is a side partial cross-sectional view of an embodiment of the anchoring portion of the improved adjustable safety breakaway mounting apparatus of the present invention.

The breakaway coupling 22 includes in the upper support member 52, a full diameter section 54 as well as reduced diameter sections 56. Preferably full diameter section 54 as shown best in FIGS. 1 and 3 has a limited vertical dimension. Preferably this limited vertical dimension is less than the vertical dimension of the post bracket hole 14. The full diameter section 54 symmetrically positions the upper support member 52 of the breakaway coupling member 22 within the extremely close tolerances of the diameter of the post bracket holes 14, which is necessary for the proper function of the load concentrating means 80 under normal loading conditions. Above and below this full diameter section 54 is a reduced diameter section 56 also being positioned within the post bracket mounting holes 14. These reduced diameter sections 56 facilitate tilting of the breakaway coupling device 22 responsive to the exertion of a lateral force near the bottom of the vertical post assembly 12.

An upper securement means 58 may be included to secure the upper support member 52 with respect to the post bracket mounting holes 14 of the vertical post assembly 12. This upper securement means 58 preferably includes an upper male threaded member 60 on the uppermost portion of the breakaway coupling 22 which extends upwardly through the post bracket hole 14. An upper nut member 62 may be secured upon the uppermost portion of the upper male threaded member 60 to be tightened downwardly thereon to urge the vertical post assembly 12 to move downward into firm securing abutment with respect to the main shaft member 50. In this manner, the post bracket 11 is firmly mounted on the upper surface of the enlarged coupling section 78 thereby fixedly securing of the breakaway coupling 22 with respect to the vertical post assembly 12.

In the preferred configuration of the present invention, load concentrating means 80 may be positioned above and below the post bracket 11 of the vertical post assembly 12 adjacent each post hole 14 therein such that they will be sandwiched in between the post bracket 11 and the upper nut member 62 on the top of the post hole 14 and upper surface of the enlarged coupling section 78 adjacent the lower area of the post hole 14. Load concentrating means 80 will be positioned between the center of the breakaway coupling 22 and the center of the post 10. The load concentrating means 80 which may be embodied in the form of a washer 86 is fixedly attached to the post bracket 11. The location of the centerline of the load concentrating means 80 in relation to the centerline of the breakaway coupling 22 is designed to minimize or eliminate the bending motion experienced by the weakened section 74 from the normal lateral forces exerted on the vertical post 10 at a location spatially remote from the breakaway mounting apparatus while at the same time, enhancing the chance of breaking of the breakaway coupling 22 responsive to the exertion of lateral forces near the bottom of the vertical post assembly 12. The theory of operation of this load concentrating means 80 is fully explained in U.S. Pat. No. 3,637,244 issued Jan. 25, 1972 on "Load Concentrating Breakaway Coupling" and in U.S. Pat. No. 3,967,906 issued Jul. 6, 1976 on "Safety Break-Away Ground Mounted Post Support Assemblies", both with the same inventor as in the present application. Those patents are hereby incorporated by reference into the application of the present invention in order to fully explain the operation of the load concentrating means 80.

The present invention further includes a lower securement means 64 which preferably includes a lower male threaded member 66 extending downwardly at the lowermost point of the breakaway coupling 22 and includes a lower nut member 68 detachably securable with respect to the lower male threaded member 66. In the proper configuration the lower securement means 64 of the breakaway coupling 22 will extend downwardly through the collar aperture 32 defined in the anchor collar 20. The lower male threaded member 66 will then extend downwardly below the anchor collar 20. Lower male threaded member 66 will then be engaged by the lower nut member 68 and lightly tightened to allow freedom of movement laterally of the breakaway coupling 22. The anchor collar 20 will then be threadedly engaged with the anchor body thread means 26. Once the upper support member 52 of the breakaway coupling 22 has been aligned with the post bracket hole 14 and the lower load concentrating means 80 positioned on the upper support surface of the enlarged coupling section 78, the anchor collar 20 is tightened thereby clamping the lower nut member 68 and preventing it from rotating. The breakaway coupling means 22 is then tightened using the wrench flats 51 thereby fixedly securing the breakaway coupling 22 with respect to the anchor collar 20.

The breakaway coupling further includes weakened section 74 preferably below the enlarged coupling section 78 of main shaft member 50 and above coupling support shoulder 76. This weakened section 74 will normally be a narrowed portion of the preferably monolithic breakaway coupling 22 in order to encourage breakage thereof responsive to a significant force being exerted laterally near the lower portion of the vertical post assembly 12.

The coupling support shoulder 76 is designed to be positioned in abutment with the upper collar abutment surface 34 in a position within the containment bore 40. The lateral dimension of the containment bore 40 is of significance since it must be greater than the lateral dimension of the coupling support shoulder 76 in order to define an annular clearance space 84 therebetween. This annular clearance space 84 will be defined within the containment bore 40. In a similar manner the lower support member 70 will have a lateral clearance space 72 between it and the collar aperture 32 and also in like manner a nut clearance space 90 is provided between the ends of the lower nut member 68 and the inner walls of the anchor chamber 24. Since the lateral clearance at all three of these locations 72, 84 and 90 are nearly identical, the annular clearance space 84 will define them all and all can be equal. Of course, these three clearances can also be configured unequal with the limit in total lateral movement or adjustment being determined by the smallest of the three clearances.

These clearance spaces 72, 84 and 90 will allow lateral movability of the breakaway coupling 22 with respect to the anchor collar 20 and with respect to the anchor body 18 if the lower nut member 68 is tightened to a loose but snug position. In this loose snug position, lower nut member 68 will allow an element of lateral movement of the breakaway coupling 22 with respect to the anchor body 18 through a distance equal to the smallest of the three clearances spaces 72,84 and 90. In this manner some element of horizontal adjustability will be achieved in this design which has not been available heretofore.

Figure 14:
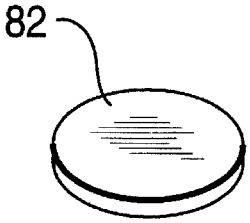
FIG. 14 is a top plan view of an embodiment of the spacer or washer of the vertical adjustment means used to vertically adjust the position of the breakaway coupling device with respect to the anchor of the present invention.
Figure 15:
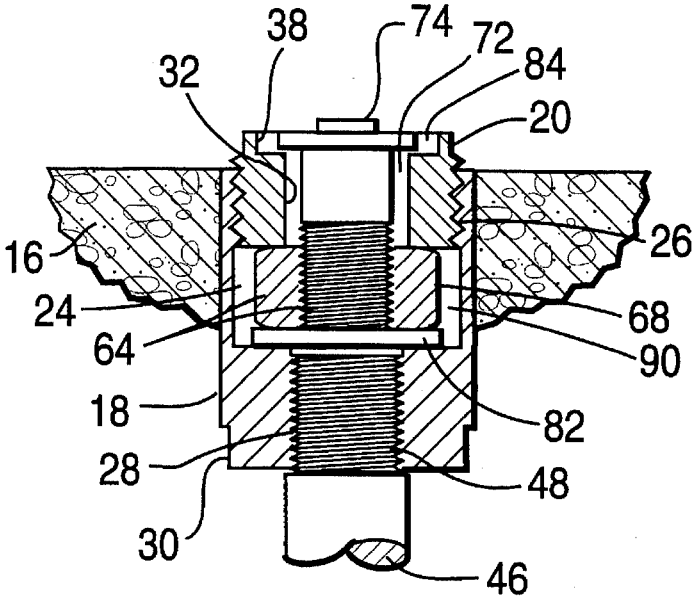
FIG. 15 is a side cross-sectional view of an alternative embodiment of the present invention including the positioning of the spacer or washer for vertical adjustment.

Vertical adjustability, if required, is achieved by rotational movement between the anchor collar 20 and the anchor body 18. Vertical adjustability is further achieved by positioning a vertical adjustment means such as washer 82, see FIG. 14, of the required thickness onto the bottom surface of the anchor chamber 24 as shown in the configuration in FIG. 15. Vertical adjustment spacing means 82 allows vertical raising of the height of the coupling support shoulder 76 of the breakaway coupling 22. The placing of these vertical adjustment washers 82 is done prior to insertion of the lower support member 70 into the anchor chamber 24. The lateral distance across the vertical adjustment washer 82 is preferably less than the lateral distance of the anchor chamber 24. The rotational movement of the anchor collar 20 with respect to the anchor body 18 fixedly secures the vertical adjustment means or washer 82 to the anchor body 18, after the lower securement means 64 of the breakaway coupling 22 has been installed.

An alternative configuration for the present invention is shown in FIG. 11 wherein the anchor body 18 is fixedly secured to a foundation 16 by means other than anchor rods 46. Anchor body is shown in FIG. 11 secured to a metallic foundation by welding thereto as shown by weld spots 88. Similarly, the anchor collar 20 could also be screwed directly into the foundation 16 if a hole and threaded means were inserted therein. With this configuration the operative aspects are identical to the configuration using the anchor rods 46 since the system is similarly vertically and horizontally adjustable. Only the means of securement to the foundation is different from the apparatus shown in the other Figures.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved adjustable safety breakaway mounting apparatus, for attachment of a vertical post assembly defining post bracket mounting holes therein with respect to a foundation, comprising:

A. an anchor means fixedly secured to a foundation, said anchor means comprising:

(1) an anchor body means defining an anchor chamber means therein;

(2) an anchor collar means detachably and adjustably secured to said anchor body means and defining a collar aperture means extending therethrough being in communication with respect to said anchor chamber means, said anchor collar means being vertically adjustable with respect to said anchor body means, said anchor collar means further including:

a. an upper collar abutment surface extending around said collar aperture means and facing generally upwardly therefrom;

b. a lower collar abutment surface extending around said collar aperture means and facing generally downwardly therefrom;

c. a collar lip means extending upwardly from said upper collar abutment surface and peripherally therearound, said collar lip means extending around said collar aperture means defined in said anchor collar means, said upper collar abutment surface and said collar lip means together defining a containment bore means thereadjacent facing upwardly;

B. a breakaway coupling means including;

(1) a main shaft member extending generally vertically, said main shaft member comprising a plurality of monolithic shaft members each extending vertically into the post bracket mounting holes and into said anchor chamber means of said anchor means to enhance structural stability therebetween;

(2) an upper support member extending into the post bracket mounting hole defined in the vertical post assembly and securable therewithin;

(3) an upper securement means operative to detachably secure said breakaway coupling means to the vertical post assembly by securement of said upper support member in position extending through the post bracket mounting hole;

(4) a lower support member detachably securable to said anchor body means by securement thereof in position extending through said collar aperture means into said anchor chamber means therebelow, said lower support member being smaller than said collar aperture means to define together a lateral clearance space therebetween to provide lateral moveability of said breakaway coupling means with respect to said anchor collar means and said anchor body means to facilitate lateral adjustment therebetween;

(5) a lower securement means operative to detachably and fixedly secure said breakaway coupling means to said anchor collar means by securement of said lower support member in position extending through said collar aperture means into said anchor chamber means therebelow to facilitate vertical adjustment in the position of affixing of said breakaway coupling means with respect to said anchor body means;

(6) a weakened section positioned between said upper support member and said lower support member and being breakable to facilitate release of the vertical post assembly from said anchor collar means of said anchor means responsive to exertion of lateral force on the vertical post assembly in the area adjacent said breakaway coupling;

(7) a coupling support shoulder positioned below said weakened section and being adjustably retained within said containment bore means to facilitate maintaining of vertical alignment of said breakaway coupling while simultaneously allowing lateral adjustment thereof, said coupling support shoulder being retained within said containment bore means and cooperating with said collar lip means extending peripherally therearound to allow limited horizontal movement of said breakaway coupling means for facilitating horizontal adjustment of positioning of said breakaway coupling means with respect to said anchor means, said anchor collar means cooperating with said anchor body means and said lower securement means to provide vertical adjustment in positioning of said breakaway coupling means with respect to said anchor body means while also cooperating with said coupling support shoulder within said containment bore means and said lateral clearance space to provide horizontal adjustment therebetween; and C. a load concentrating means positioned between said breakaway coupling means and the vertical post assembly adjacent said post bracket mounting hole to enhance breaking of said weakened section responsive to lateral force being exerted on the vertical post assembly adjacent said breakaway coupling and to resist breaking of said weakened section responsive to lateral force exerted on the vertical post assembly distant from said breakaway coupling means.

2. An improved adjustable safety breakaway mounting apparatus for attachment of a vertical post assembly defining post bracket mounting holes therein with respect to a foundation as defined in claim 1 wherein said upper support member includes:

A. a full diameter section for concentrically positioning the post bracket mounting hole therearound;

B. a reduced diameter section extending both above and below said full diameter section and immediately thereadjacent within said post bracket mounting hole to facilitate tilting of said breakaway coupling means and further facilitate breaking of said weakened section responsive to exertion of a lateral force on the vertical post assembly in the area adjacent said breakaway coupling; and C. an upper male threaded member positioned extending upwardly from said reduced diameter section above said full diameter section.

3. An improved adjustable safety breakaway mounting apparatus for attachment of a vertical post assembly defining post bracket mounting holes therein with respect to a foundation as defined in claim 1 wherein said anchor body means defines anchor body thread means within said anchor chamber means and wherein said anchor collar means defines anchor collar thread means thereon, said anchor body thread means being engageable with said anchor collar thread means to facilitate vertical adjustability and securement of said breakaway coupling means with respect to said anchor means.

4. An improved adjustable safety breakaway mounting apparatus for attachment of a vertical post assembly defining post bracket mounting holes therein with respect to a foundation as defined in claim 1 further comprising an anchor rod means attached to said anchor body means and extending downwardly therefrom into the foundation to facilitate securement of said anchor body means with respect thereto.

5. An improved adjustable safety breakaway mounting apparatus for attachment of a vertical post assembly defining post bracket mounting holes therein with respect to a foundation as defined in claim 4 wherein said anchor rod means is fixedly secured to the exterior of said anchor body means and wherein said anchor chamber means of said anchor body means is sealed from the ambient environment to prevent deterioration thereof.

6. An improved adjustable safety breakaway mounting apparatus for attachment of a vertical post assembly defining post bracket mounting holes therein with respect to a foundation as defined in claim 5 wherein said anchor body defines a threaded orifice therein and wherein said anchor rod means includes a threaded rod area adapted to extend into said threaded orifice for engagement therewith to facilitate securement of said anchor body means with respect to a foundation.

7. An improved adjustable safety breakaway mounting apparatus for attachment of a vertical post assembly defining post bracket mounting holes therein with respect to a foundation as defined in claim 1 wherein said upper securement means comprises an upper male threaded member located on said breakaway coupling means and an upper nut member engageable with said upper male threaded member to detachably affix said breakaway coupling means and said load concentrating means with respect to the vertical post assembly.

8. An improved adjustable safety breakaway mounting apparatus for attachment of a vertical post assembly defining post bracket mounting holes therein with respect to a foundation as defined in claim 7 wherein said lower securement means comprises a lower male threaded member positioned on said breakaway coupling means extending through said collar aperture means into said anchor chamber means and a lower nut member engageable with said lower male threaded member within said anchor chamber means to affix said breakaway coupling means with respect to said anchor collar means of said anchor body with said lower nut member in abutment with respect to said lower collar abutment surface.

9. An improved adjustable safety breakaway mounting apparatus for attachment of a vertical post assembly defining post bracket mounting holes therein with respect to a foundation as defined in claim 8 further comprising vertical spacing means positioned within said anchor chamber means to facilitate tight positioning of said anchor body means with respect to said lower nut means and said lower support member of said breakaway coupling means.

10. An improved adjustable safety breakaway mounting apparatus for attachment of a vertical post assembly defining post bracket mounting holes therein with respect to a foundation as defined in claim 1 wherein said anchor body means includes a locking notch means therein to facilitate rotational locking engagement thereof with respect to the foundation.

11. An improved adjustable safety breakaway mounting apparatus for attachment of a vertical post assembly defining post bracket mounting holes therein with respect to a foundation as defined in claim 1 further comprising sealant means positioned between said containment bore means and said coupling support shoulder for facilitating sealing therebetween.

12. An improved adjustable safety breakaway mounting apparatus for attachment of a vertical post assembly defining post bracket mounting holes therein with respect to a foundation as defined in claim 1 wherein said anchor means comprises at least two anchor members positioned in spaced relation with respect to one another affixed to the foundation and wherein said breakaway coupling means comprises at least two breakaway coupling members each independently affixed to one of said two anchor members to facilitate securement of a vertical post assembly thereto and wherein said load concentrating means comprises at least four load concentrating means, two positioned adjacent to each one of said breakaway coupling members.

13. An improved adjustable safety breakaway mounting apparatus for attachment of a vertical post assembly defining post bracket mounting holes therein with respect to a foundation as defined in claim 1 wherein said anchor collar means includes a collar gripping flat means located on said collar lip means to facilitate rotational movement thereof.

14. An improved adjustable safety breakaway mounting apparatus for attachment of a vertical post assembly defining post bracket mounting holes therein with respect to a foundation as defined in claim 1 further comprising vertical post bracket means secured to the vertical post assembly and defining post bracket mounting holes therein to facilitate securement with respect to said breakaway coupling means.

15. An improved adjustable safety breakaway mounting apparatus for attachment of a vertical post assembly defining post bracket mounting holes therein with respect to a foundation as defined in claim 1 wherein said main shaft member includes an enlarged coupling section positioned below said upper support member of said breakaway coupling means to facilitate securement thereof with respect to the post bracket mounting holes, said enlarged coupling section including wrenching flats on the exterior thereof to facilitate gripping thereof.

16. An improved adjustable safety breakaway mounting apparatus for attachment of a vertical post assembly defining post bracket mounting holes therein with respect to a foundation as defined in claim 1 wherein said coupling support shoulder defines an annular clearance space extending therearound within said containment bore means to allow said coupling support shoulder to be movable with respect to said anchor collar means.

17. An improved adjustable safety breakaway mounting apparatus for attachment of a vertical post assembly defining post bracket mounting holes therein with respect to a foundation as defined in claim 16 wherein said annular clearance space is horizontally approximately equal in dimension to the horizontal dimension of said lateral clearance space around said lower support member when positioned within said collar aperture means to further facilitate horizontal adjustment of the relative horizontal positions of said breakaway coupling means with respect to said anchor means.

18. An improved adjustable safety breakaway mounting apparatus for attachment of a vertical post assembly defining post bracket mounting holes therein with respect to a foundation as defined in claim 1 wherein said coupling support shoulder is retained in position within said containment bore means responsive to vertical adjustment in positioning of said breakaway coupling means with respect to said anchor means to facilitate horizontal adjustment in positioning therebetween.

19. An improved adjustable safety breakaway mounting apparatus for attachment of a vertical post assembly defining post bracket mounting holes therein with respect to a foundation as defined in claim 1 wherein said load concentrating means comprises load concentrating washers detachably securable between said upper securement means and the vertical post assembly.

20. An improved adjustable safety breakaway mounting apparatus, for attachment of a vertical post assembly defining post bracket mounting holes therein with respect to a foundation, comprising:

A. an anchor means fixedly secured to a foundation, said anchor means comprising:

(1) an anchor body means defining an anchor chamber means therein, said anchor body further defining anchor body thread means thereon within said anchor chamber means, said anchor body means further defining a threaded orifice therein, said anchor body means further defining a locking notch means therein to facilitate fixed rotational securement thereof with respect to the foundation;

(2) an anchor collar means detachably and adjustably secured to said anchor body means and defining a collar aperture means extending therethrough being in communication with respect to said anchor chamber means, said anchor collar means being vertically adjustable with respect to said anchor body means, said anchor collar means further including:

a. an upper collar abutment surface extending around said collar aperture means and facing generally upwardly therefrom;

b. a lower collar abutment surface extending around said collar aperture means and facing generally downwardly therefrom;

c. a collar lip means extending upwardly from said upper collar abutment surface and peripherally therearound, said collar lip means extending around said collar aperture means defined in said anchor collar means, said upper collar abutment surface and said collar lip means together defining a containment bore means thereadjacent facing upwardly;

d. an anchor collar thread means engageable with respect to said anchor body thread means to facilitate adjustable securement of said anchor collar means with respect to said anchor body means;

e. a collar gripping flat means located on said collar lip means to facilitate rotational control of movement and adjustment thereof;

(3) anchor rod means including a threaded rod area being securable with respect to said threaded orifice of said anchor body to attach said anchor rod means with respect to said anchor body means, said anchor rod means extending downwardly from said anchor means for facilitating securement of said anchor means with respect to the foundation;

B. a breakaway coupling means formed as a single monolithic integral member which includes;

(1) a main shaft member extending generally vertically, said main shaft member comprising a plurality of monolithic shaft members each extending vertically into the post bracket mounting holes and into said anchor chamber means of said anchor means to enhance structural stability therebetween;

(2) an upper support member extending into the post bracket mounting hole defined in the vertical post assembly and securable therewithin, said upper support member including;

a. a full diameter section; and b. a reduced diameter section adjacent said full diameter section within post bracket mounting hole to facilitate tilting of said breakaway coupling means and further facilitate breaking of said weakened section thereof responsive to exertion of a lateral force on the vertical post assembly in the area adjacent said breakaway coupling, said reduced diameter section being located above said full diameter section and below said full diameter section;

(3) an upper securement means operative to detachably secure said breakaway coupling means to the vertical post assembly by securement of said upper support member in position extending through the post bracket mounting hole, said upper securement means including;

a. an upper male threaded member located at the top of said upper support member;

b. an upper nut member engageable with said upper male threaded member above the post bracket mounting hole to detachably affix said breakaway coupling means with load concentrating means attached thereto with respect to the vertical post assembly;

(4) a lower support member detachably securable to said anchor body means by securement thereof in position extending through said collar aperture means into said anchor chamber means therebelow, said lower support member being smaller than said collar aperture means to define together a lateral clearance space therebetween to provide lateral moveability of said breakaway coupling means with respect to said anchor collar means and said anchor body means to facilitate lateral adjustment therebetween;

(5) a lower securement means operative to detachably and fixedly secure said breakaway coupling means to said anchor collar means by securement of said lower support member in position extending through said collar aperture means into said anchor chamber means therebelow to facilitate vertical adjustment in the position of affixing of said breakaway coupling means with respect to said anchor body means, said lower securement means including;

a. a lower male threaded member located at the bottom of said lower support member within said anchor chamber means;

b. a lower nut member engageable with said lower male threaded member below said collar aperture means within said anchor chamber means to detachably affix said breakaway coupling means with respect to said anchor body means, said lower nut member engageable with said lower collar abutment surface to affix said breakaway coupling means with respect to said anchor collar means, said lower nut member having sufficient clearance within said anchor chamber means to allow horizontal movement thereof;

(6) a weakened section positioned between said upper support member and said lower support member and being breakable to facilitate release of the vertical post assembly from said anchor means responsive to exertion of lateral force-on the vertical post assembly adjacent said breakaway coupling;

(7) a coupling support shoulder positioned immediately below said weakened section and being adjustably retained within said containment bore means to facilitate maintaining of vertical alignment of said breakaway coupling while simultaneously providing lateral adjustment thereof, said coupling support shoulder being retained within said containment bore means and cooperating with said collar lip means extending peripherally therearound to allow limited horizontal movement of said breakaway coupling means for facilitating horizontal adjustment of positioning of said breakaway coupling means with respect to said anchor means, said anchor collar means cooperating with said anchor body means and, said lower securement means to provide vertical adjustment in positioning of said breakaway coupling means with respect to said anchor body means while also cooperating with said coupling support shoulder within said containment bore means and said lateral clearance space to provide horizontal adjustment therebetween;

(8) an enlarged coupling section positioned below said upper support member for attachment with respect to the vertical post assembly to facilitate securement of said upper support member with respect to the post bracket mounting hole;

C. a load concentrating means positioned between the upper surface of said enlarged coupling section of said breakaway coupling means and the post bracket of the vertical post assembly adjacent said post bracket mounting hole means to facilitate breaking of said weakened section responsive to lateral force being exerted on the vertical post assembly adjacent said breakaway coupling and to resist breaking of said weakened section responsive to lateral force exerted on the vertical post assembly distant from said breakaway coupling;

D. a vertical spacing means positioned within said anchor chamber means to facilitate tight abutment of said anchor body means with respect to said lower nut member and said lower support member of said breakaway coupling means and to facilitate vertical adjustment of relative positioning between said breakaway coupling means and said anchor means; and E. a post bracket means secured to said vertical post assembly and defining said post bracket mounting holes therein.

* * * * *